US007218240B2

(12) United States Patent
Tillotson

(10) Patent No.: US 7,218,240 B2
(45) Date of Patent: May 15, 2007

(54) SYNTHETICALLY GENERATED SOUND CUES

(75) Inventor: Brian J. Tillotson, Kent, WA (US)

(73) Assignee: The Boeing Company, Chicago, IL (US)

( * ) Notice: Subject to any disclaimer, the term of this patent is extended or adjusted under 35 U.S.C. 154(b) by 189 days.

(21) Appl. No.: 10/915,309

(22) Filed: Aug. 10, 2004

(65) Prior Publication Data

US 2006/0034463 A1 Feb. 16, 2006

(51) Int. Cl.
*G08B 25/08* (2006.01)

(52) U.S. Cl. ..... 340/692; 340/691.6; 340/425.5; 340/426.22; 381/1; 381/71.2; 381/89; 713/176

(58) Field of Classification Search ..... 340/692, 340/691.6, 425.5, 426.22; 381/1, 71.2, 89; 713/176

See application file for complete search history.

(56) References Cited

U.S. PATENT DOCUMENTS

| | | | | |
|---|---|---|---|---|
| 6,536,553 | B1 * | 3/2003 | Scanlon | 181/108 |
| 6,766,745 | B1 * | 7/2004 | Kuklinski et al. | 102/402 |
| 2004/0065247 | A1 * | 4/2004 | Horton | 114/322 |

OTHER PUBLICATIONS

Brewster, Stephen; *Providing A Model For The Use Of Sound In User Interfaces*; Jun. 28, 1991; Department of Computer Science, University of York, Heslington, York.

Orosz, Karplus, Balakrishnan; *Using Virtual 3-D Audio In Multi-Speech Channel And Multimedia Environments*; undated; www.cs.ucla.edu.

Foyle, David C.; *Taxiway Navigation and Situation Awareness System (T-NASA) Empirical Research*; article; undated; Human-Centered Systems Lab, California.

Foyle, David C.; *Taxiway Navigation and Situation Awareness System (T-NASA) Electronic Moving Map (EMM)*; article; undated; Human-Centered Systems Lab, California.

Foyle, David C.; *Taxiway Navigation and Situation Awareness System (T-NASA) Head-Up Display (HUD)*; article; undated; Human-Centered Systems Lab, California.

Foyle, David C.; *Taxiway Navigation and Situation Awareness System (T-NASA) 3-D Audio Alerts and Warnings*; article; undated; Human-Centered Systems Lab, California.

Foyle, David C.; *HSCL Research: Taxiway Navigation and Situation Awareness System (T-NASA) Overview*; article; undated; Human-Centered Systems Lab, California.

* cited by examiner

*Primary Examiner*—Tai Nguyen
(74) *Attorney, Agent, or Firm*—Harness, Dickey & Pierce, P.L.C.

(57) ABSTRACT

Communication systems and apparatus to allow a user to perceive the relative spatial location or present position of other elements of interest in a control space, such as the location of a speaker participating in a telephone conference or that of an aircraft carrier to a remotely piloted vehicle on final approach. The system inserts synthetic sound cues into the communication to the user that represent the relative postion(s). In one embodiment, the user will perceive the communication as though it were communicated through free space to the user from the relative position of the represented source, so that, for example, the squad leader will perceive his wingman to be at his immediate left. Methods of conveying relative position sound cues are also provided.

31 Claims, 5 Drawing Sheets

SYNTHETICALLY GENERATED SOUND CUES

STATEMENT REGARDING FEDERALLY SPONSORED RESEARCH OR DEVELOPMENT

This invention was developed in the course of work under U.S. government contract MDA972-02-9-0005. The U.S. government may possess certain rights in the invention.

FIELD OF THE INVENTION

This invention relates generally to communications systems and methods and, more particularly, to telecommunication systems used to improve situational awareness of users in human-in-the-loop systems.

BACKGROUND OF THE INVENTION

A wide variety of situations exist in which improved situational awareness may be of critical importance. For instance, air traffic controllers need to be aware of where their aircraft are, where other controllers' aircraft are as the aircraft enter air space controlled by the first controller, and to where those aircraft might be traveling. If the controller's knowledge can be improved, then it might be possible to safely allow more aircraft to traverse a given volume of airspace at any given time. Likewise, emergency workers responding to natural disasters, as well as members of the armed services, need to be aware of the actions their teammates and other parties may be undertaking. Failure to quickly and correctly comprehend and assess the situation (i.e. having insufficient situational awareness), particularly failure to know the positions of cooperating parties, may produce less than optimal team performance.

Situational awareness is also of increasing importance because many organizations are increasing the use of unmanned aerial vehicles (UAV) to reduce costs and personnel risks while also improving the organization's effectiveness. Scenarios in which several UAVs cooperate to accomplish a mission (e.g. a search) give rise to the possibility that the operator of one UAV may not accurately know the position of another UAV. Thus, the operator may partially duplicate a search already conducted by the operator of the other UAV or be unable to respond to requests for assistance from the other UAV operator. For example, if a UAV operator is pursuing two suspects and the pair of fugitives split up to escape, the operator of another UAV (who is unfortunately not aware of the pursuing UAV's current whereabouts) might be unable to acquire one of the two suspects rapidly enough to prevent one of the fugitives from evading the pair of pursuing UAVs that are cooperating such that first UAV maintains the pursuit of one suspect while the second UAV acquires, and pursues, the other suspect.

Thus, a need exists to provide a simple, intuitive way to improve the situational awareness of operators, particularly when more than one human-in-the-loop system cooperates with another to accomplish a common goal.

SUMMARY OF THE INVENTION

It is in view of the above problems that the present invention was developed. The invention includes methods and systems used in communications systems to improve the situational awareness of the users of the communication system.

In a preferred embodiment, the present invention provides a computerized audio system that distinguishes between incoming audio signals and adjusts each signal to cause the recipient to perceive the signals as coming from a particular direction, distance, and elevation. To distinguish the incoming signals from each other the system may use a digital address of the sender (e.g. an I.P. address) or may use the phone line through which the audio signal comes (e.g. for a multi-line conference call). Of course, the present invention is not limited by these exemplary embodiments. For instance even a TDMA (Time Division Multiple Access) network could be used in conjunction with the present invention. Once the audio signals are distinguished from each other, the system then associates a relative position with each of the audio signals from which the recipient will perceive the audible signal (to be produced from the audio signal) as coming. The perceived positions associated with the signals may be distributed and arbitrarily associated with the signals to provide optimum audible separation of the sources. These arbitrary assignments are well suited for situations wherein the actual position of the signal's origin (i.e. the sound source) is unavailable or not of consequence. Where the position of the origin is known, or important to the recipient, the associated position may indicate the true direction to the source and may even be adjusted to give an indication of the distance to the source. For example, the bearing of the perceived position and that of the source may be approximately equal with the perceived distance being proportional to the true distance. In still other preferred embodiments, the perceived position may be chosen based on the location of a device associated with the source so that the perceived relative position does not match the position of the source itself. Rather, the perceived relative position matches that of the device. An example of the latter situation includes the source being an operator of a UAV and the perceived position being chosen so as to indicate the position of the UAV. Building on this concept, the location of a device controlled by the recipient of the audio signal may also be used to assign the perceived relative position of the sound. In other words, if the recipient is operating another UAV, the perceived position may be chosen to convey to the recipient the relative position of the source's UAV with respect to the recipient's UAV.

In a second preferred embodiment, the system provides sound cues to an operator in a scenario that includes spaced mobile platforms with a changing frame of reference, such as two remotely piloted vehicles operating in a shared airspace or a remotely piloted vehicle on a landing approach to a carrier. The cued operator receives an audible signal that includes cues for the relative position of the other platforms with respect to the position of the operator's vehicle. That is, in the case of two platforms, the signal is modulated to appear to the operator as though it were being transmitted to the operator from the location of the other platform, allowing the operator to know intuitively from the sound the relative spatial relationship between the operator's vehicle and the other platform. Since this system is synthetic there does not have to be actual communication between the two platforms. The present invention provides the operator of one platform cues so that the operator will know where the other platform(s) are. These cues could arise from active communication or by sensing the position of the other platforms.

In a third preferred embodiment, a system of mobile platforms is provided. The system includes a first and a second mobile platform with a relative position there between. Additionally, the system includes a communications subsystem and two controllers for the users to control the mobile platforms. The communications subsystem allows the first user to send an audio signal to the second user. Further, the communication subsystem modifies the signal so that the second user perceives an audible signal from the direction of the relative position of the second mobile platform with respect to the first mobile platform. In a preferred embodiment, the mobile platforms are unmanned aerial vehicles.

In a fourth preferred embodiment, a method of communicating at least one audio signal from a source to a recipient is provided. The method includes associating a relative position with the source and modifying the audio signal to convey the relative position. The modified signal is presented to the recipient so that the recipient perceives an audible signal conveying the relative position associated with the source. Where more than one source is present, the association of various relative positions with each source can be arbitrary and may also occur in real time. Further, the relative positions may be chosen from positions on a circle disposed about the recipient. In addition to modifying the signal(s) to reflect a relative position, the signal may be modified to reflect a relative movement. In yet other preferred embodiments, the associated relative position may be based on a spatial relative position or on a logical address associated with the signal. In yet other embodiments, the signal may be generated by speaking.

Another preferred embodiment provides a communication system. The system of the present embodiment includes a signal modifier and a position associater. The position associater associates a relative position with an audio signal. The signal modifier modifies the audio signal to convey the associated relative position and outputs the modified audio signal. Thus, the recipient perceives an audible signal conveying the associated relative position. In other preferred embodiments, the system includes an audio subsystem that accepts the modified audio signal and reproduces the audible signal (as modified) for the recipient. The signal modifier may also retrieve an acoustic model from a memory and use the model in modifying the audio signal. The system may also include a link to a telephony system from which the system accepts the audio signal and a caller identification signal. In these latter embodiments, the position associater may use the caller identification signal in associating the relative position with the voice signal.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
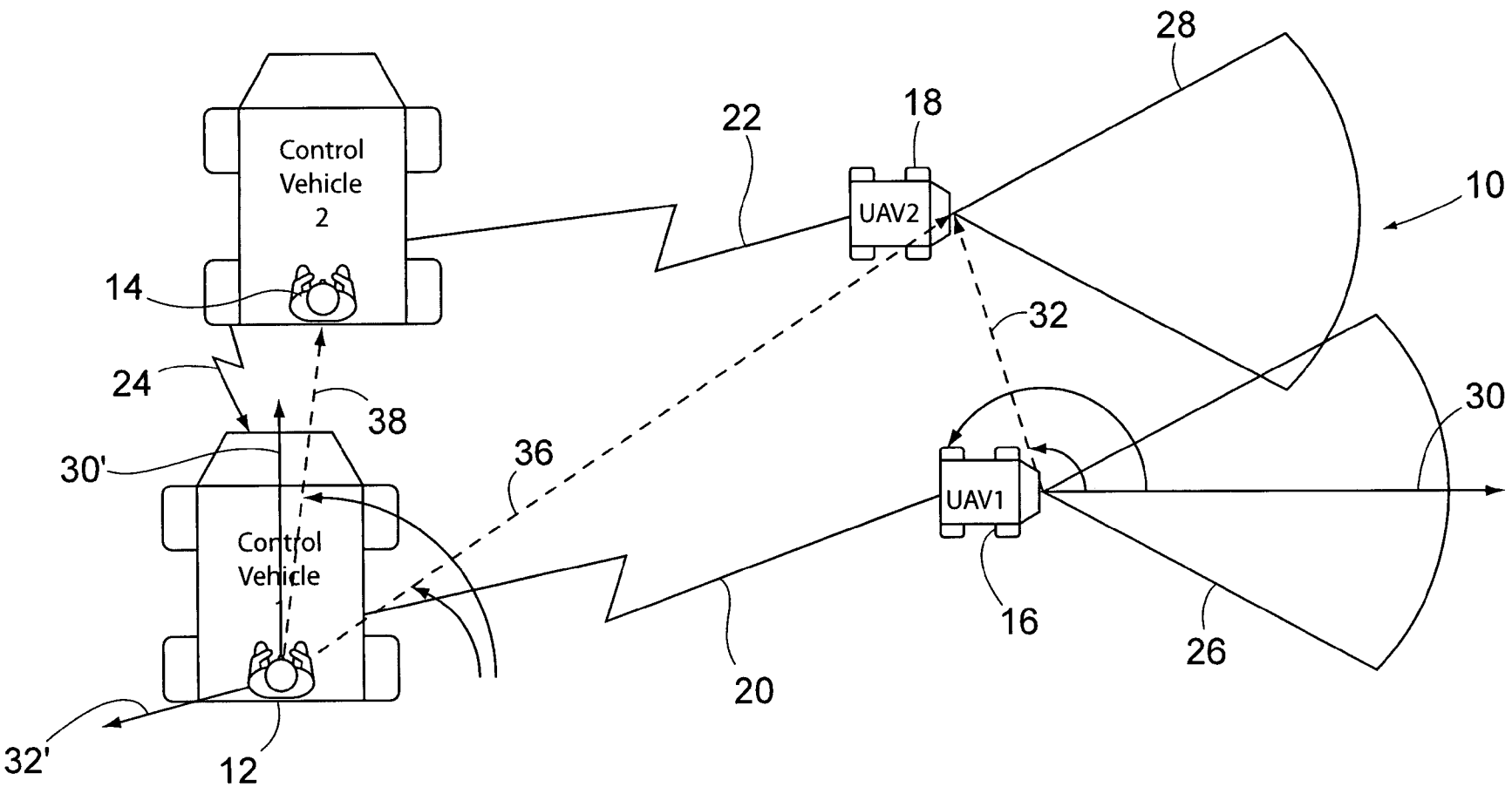
FIG. 1 illustrates a system constructed in accordance with the principles of the present invention.

Referring to the accompanying drawings in which like reference numbers indicate like elements, FIG. 1 illustrates a telecommunication system constructed in accordance with the principles of the present invention.

The present invention takes advantage of the ability of humans to use sound cues to judge the azimuth, elevation, and distance of a sound source. These audio cues can be simulated in electronic systems that feed headphones, loudspeakers, or other sound producing devices. The listener thus perceives the produced sound as coming from a particular position, even though the speakers are at different positions than the perceived position of the produced sound. To convey a particular azimuth, these systems typically create delays between the reception of a sound by one ear and the reception of the same sound by the other ear. In addition to the interaural delay, the system may create a slight difference in intensity, or volume, as received by one ear over the other to further enhance the "stereo" effect.

Distance may also be simulated simply by varying the intensity of the sound. In the alternative, these systems can apply a model of sound propagation in a particular acoustic environment (e.g. a snowy field or a conference room) to the audio signal to cause the recipient to perceive the desired position of the sound. For instance, the model can add echoes with appropriate delays to indicate sound reflecting off of various surfaces in the simulated environment. The model may also "color" (e.g. adjust the timbre of the sound) the sound to indicate the atmosphere, and other objects, attenuating the sound as it propagates through the environment. As to the perceived elevation of a sound source, these systems may also color the audio signal to approximately match the coloring done by the human ear when a sound comes from a particular elevation. Thus, the system is capable of producing quadraphonic, surround sound, or three-dimensional affects to convey the relative position and orientation of one platform 16 with respect to the other platform 18.

Turning now to FIG. 1, the exemplary system 10 includes a voice message recipient 12 and a voice source 14 along with a pair of platforms 16 and 18 controlled by the recipient 12 and source 14, respectively. The system 10 includes means to appraise the recipient 12 of the position of the platform 18 relative to the platform 16. Further, the knowledge of the relative location of the platform 18 may be imparted to the recipient 12 in real time and in an intuitive manner as is herein described. It will also be understood that the recipient may act as an audio source and visa versa. As shown, the platforms 16 and 18 may be unmanned aerial vehicles (UAVs), although the platforms could be any type of platform capable of having a position, or movement, independent of the recipient 12 and source 14. Exemplary mobile platforms include aircraft, spacecraft, unmanned aerial vehicles (whether remotely piloted or autonomous), submersible vehicles, cranes, tools (e.g. assembly or machining robots), trucks, cars, etc. In general, though, mobile platforms include any vehicle capable of movement or being moved. Thus, the system also includes communication links 20 and 22 between the operators 12 and 14 and the exemplary UAVs 16 and 18 as shown in FIG. 1. An additional communication link 24 is shown between the vehicle of recipient 12 and the vehicle of source 14. While the communication link 24 usually carries audio signals, other signals (e.g. video signals from the UAVs 16 and 18 and digital data) are within the scope of the present invention. Also shown are the fields of view 26 and 28 of the UAVs 16 and 18. While the recipient 12, the source 14, and the UAVs 16 and 18 might be within the field of view of one another, or even co-located, frequently these components will be separated by some distance and will likely be shielded from the view of each other. Nonetheless, the operators of the UAVs 16 and 18 frequently desire to know where the UAV operated by the other operator is positioned.

With continuing reference to FIG. 1, the UAV 16 has a heading 30 which is also shown having been translated to the recipient 12 as 30.' From the UAV 16, relative position 32 point toward the UAV 18 and the source 14. Also, relative positions 36 and 38 point from the recipient 12 to the UAV 18 and to the source 14. Generally, the recipient 12 knows the position of the UAV 16 and the position of the source 14, although this is not always the case. Frequently the recipient 12 is ignorant of the position of the UAV 18 since it is controlled by the source 14.

In operation, the recipient 12 controls the UAV 16 via the data link 20 and receives information from the UAV 16 via the link 20. In particular, the recipient 12 views the field of view 26 and adjusts the operation of the UAV 16 according to the information thereby derived. Similarly, the source 14 controls the UAV 18. When the source 14 desires assistance from the UAV 16, the source 14 communicates its desire for assistance over the link 24. In turn, the recipient 12 of the request steers the UAV 16 to the vicinity of the UAV 18, thereby adding the capabilities of the UAV 16 to those of the UAV 18. Of course, this optimal scenario presupposes that the recipient 12 knows the relative position of the UAV 18 with respect to the UAV 16. If this is not the case, the recipient 12 may steer the UAV 16 in such a manner as to not render the requested assistance (i.e. the recipient 12 turns the UAV 16 the wrong way).

Figure 2:
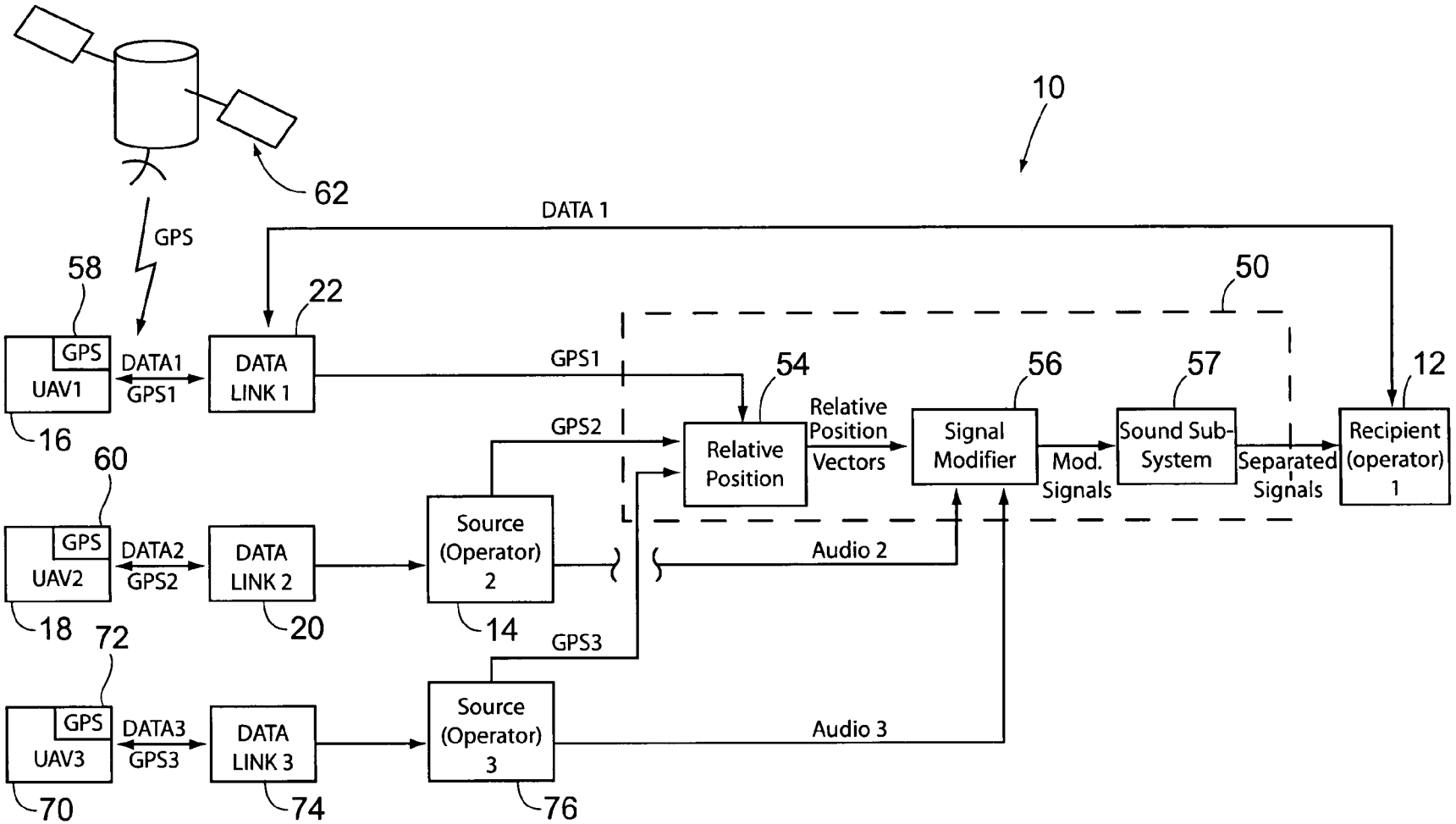
FIG. 2 illustrates a telecommunications system constructed in accordance with another preferred embodiment of the present invention.

With reference now to FIG. 2, a block diagram of the system 10 is shown. In particular, FIG. 2 includes a relative position and orientation subsystem 50. The subsystem 50 includes a relative position comparator 54, a signal modifier 56, and a sound reproducer 57. The UAVs 16 and 18 in FIG. 2 also include navigation subsystems 58 and 60. The navigation subsystems 58 and 60 may be any type of navigation subsystem capable of ascertaining the position and orientation of the UAVs 16 and 18. To that end, FIG. 2 shows GPS (Global Positioning System) based navigation subsystems 58 and 60 communicating with a GPS satellite 62.

The UAVs 16 and 18 send their absolute positions and the absolute orientation of UAV 16 to the relative position comparator 54 which then generates a vector defining the relative position of the UAV 18 with respect to the position and orientation of UAV 16. Of course, the system can be designed to generate relative position vectors for essentially any number of platforms without departing from the scope of the present invention. The relative position of UAV 18 is forwarded to the audio signal modifier 56 that also accepts the audio signal from the source 14. The modifier 56 then modifies the audio signal to convey the relative position of the UAV 18 (with respect to the UAV 16) to the recipient 12. The manner of modifying an audio signal to convey a relative position involves adjusting one, or more, parameters that affect the manner in which a listener perceives the audible signal. While the relative position vector may be determined in any coordinate system (e.g. in terms of Cartesian x, y, and z coordinates relative to the UAV 16), the cue, or modification to the sound, will convey the relative position to the operator of UAV 16.

For instance, intensity of the audible signal may be adjusted so that, as the intensity increases, the user perceives the sound source 14 as being closer. Reverb and echo may also be used to enhance the impression of distance to the perceived position of the sound. Stereo audio systems also adjust various parameters (e.g. interaural time, intensity, and phase differences) to create the impression that a sound source 14 is located at a particular position in a two dimensional area surrounding the recipient. A non-exhaustive list of other measures of the audio signal's timbre that may be modified to reflect the relative position or velocity of the UAV 18 include: thickening, thinning, muffling, self-animation, brilliance, vibrato, tremolo, the presence or absence of odd (and even) harmonics, pitch (e.g. the Doppler Effect), dynamics (crescendo, steady, or decrescendo), register, beat, rhythm, and envelope including attack and delay.

For the present invention, these terms will be defined as follows. "Thickening" means shifting the pitch of a signal so that the signal is heard at one, or more, frequencies in addition to the original pitch. Thickening may be used to create the illusion of a source moving closer to the recipient. "Thinning" means passing the signal through a low, high, band, or notch filter to attenuate certain frequencies of the signal. Thinning may be used to create the illusion that the source is moving away from the recipient. "Self animation" refers to frequency-dependent phase distortion to accentuate frequency variations present in the original signal. The term "brilliance' refers to the amount of high frequency energy present in the spectrum of the audio signal. "Vibrato" and "tremolo" refer to the depth and speed of frequency (vibrato) and amplitude (tremolo) modulation present in the signal. The distribution of harmonics within the signal also affects the way that a listener hears the signal. If there are only a few odd harmonics present, the listener will hear a "pure" sound rather than the thin, reed-like sound caused by the elimination of even harmonics. For more information on timbre parameters, the reader is referred to the source of these definitions: Brewster, S., Providing a Model For the Use of Sound in User Interfaces [online], June 1991, [retrieved on Apr. 25, 2004]. Retrieved from the Internet :<URL: http://www.cs.york.ac.uk/ftpdir/reports/YCS-91-169.pdf>.

The audio signal modifier 56 shown by FIG. 2 may adjust appropriate combinations of these parameters to cause the recipient 12 to perceive the audible signal (which will be reproduced from the audio signal) as coming from the relative position of the UAV 18. By "audio signal" it is meant that the signal is an electrical signal, or waveform, which represents a sound, or sounds. Audio signals may, of course be created from audible signals, and vice versa, by suitable conversion via, for instance, a microphone. By "audible signal" it is meant a signal capable of being heard (e.g. a sound or sounds). Additionally, the modification of the audio signal may be such that the variation of the pre-selected parameter(s) is proportional to the distance between the UAV 16 and 18. Thus, when the source 14 speaks, or otherwise generates a sound for representation in the audio signal, the recipient 12 will hear the corresponding, reproduced, audible signal as if the recipient 12 were co-located with the UAV 16 and as if the source 14 was co-located with the UAV 18. In other words, from the perspective of the recipient 12, the sound appears to come from the relative position 32 as translated to reference 32' at the recipient's 12 location. If the recipient 12 is trained to associate the perceived position 32' with the relative position 32 of the UAV 18, the system 10 appraises the recipient 12 of the relative position of the UAV 18 in real-time and in an intuitive manner.

In a preferred embodiment, the subsystem 50 is implemented with a modern DSP (digital signal processing) chip set for modifying the signal to include the audible cues. A high-performance DSP set allows the user to program the subsystem 50 to perform many sophisticated modifications to the signals, such as modifying each signal to match the acoustics of a particular conference room in the Pentagon with the window open. Basic modifications (e.g. phase shift, volume modification, or spectral coloring), though, can be performed by even a relatively modest 80286 CPU (available from the Intel Corp. of Santa Clara, Calif.). One of the reasons the present invention does not require sophisticated DSP hardware is that audio information is conveyed at relatively low frequencies (i.e. less than about 20,000 Hz). Thus, the present invention may be implemented with many types of technology. However, in the current embodiment, the DSP chip is coupled to a digital-to-analog stereo output (e.g. a Sound Blaster that is available from Creative Technologies Ltd. of Singapore).

Figure 3:
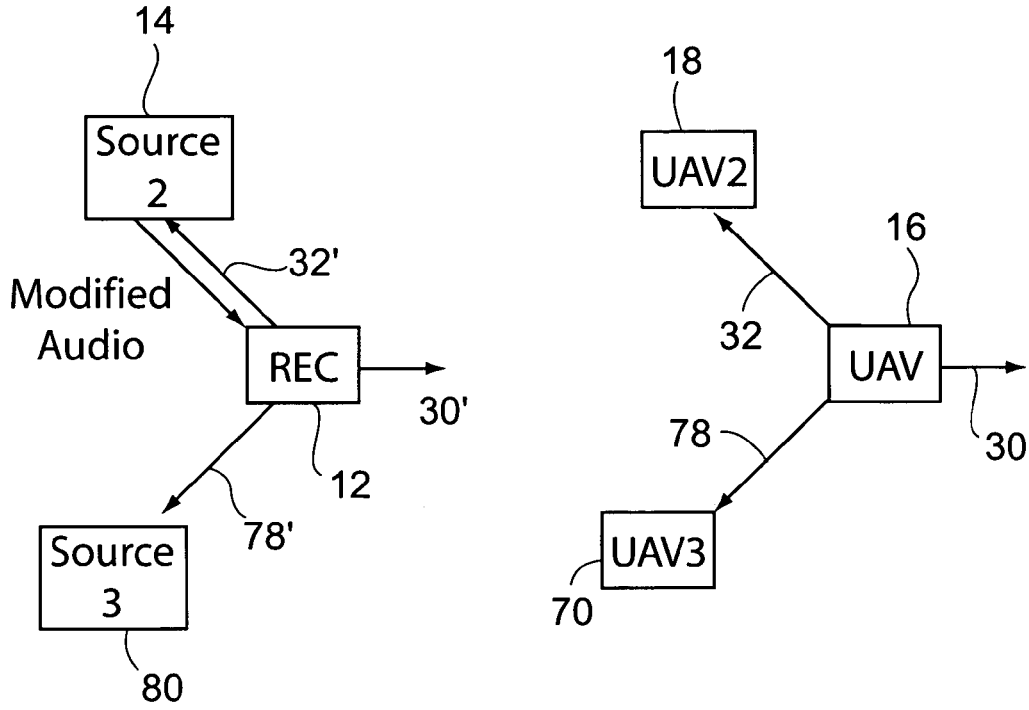
FIG. 3 further illustrates the system of FIG. 1.

FIGS. 2 and 3 show yet another preferred embodiment that includes an additional UAV 70 (controlled by a source 76 over a link 74). The presence of the additional source 76 complicates the recipient's task, in that the sources 14 and 76 might produce an audio signal at the same time. Because the recipient may not be able to a priori determine which source 14 or 76 to attend to first, the recipient 12 will generally prefer to be able to listen to both sources 14 and 76 at the same time.

The system 10 enhances the recipient's 12 ability to listen to both sources by providing the audible separation desired by the recipient 12. More particularly, the audio signal modifier 56 may be configured to modify the individual audio signals from the sources 14 and 76 to convey the relative positions 32 and 78 of the respective UAVs 18 and 70. When the audible signals are reproduced by the sound subsystem 57, the recipient 12 perceives the audible signal (associated with the source 14) coming from relative position 32' and the other audio signal (associated with source 70) coming from relative position 78.' Thus, the system 10 separates the audible signals as if the recipient 12 and the sources 14 and 76 were listening to each other at the positions of the respective UAVs 16, 18, and 70. The audible separation provided by the present invention, therefore, enhances the ability of the recipient 12 to follow the potentially simultaneous conversations of the sources 14 and 76.

In still another preferred embodiment, the relative position 36 between the recipient 12 and the UAV 18 may be used to modify the audio signal from the source 14. Thus, the source 14 would appear to speak from the position of the UAV 18. In yet another preferred embodiment, the relative position 38 between the recipient 12 and the source 14 may be used to modify the audio signal. In still another preferred embodiment, the relative positions 32' is not limited by two dimensions (e.g. east/west and north/south). Rather, the relative position 32' could be along any direction in three-dimensional space as, for example, when one of the sources 14 is onboard a mobile platform such as an aircraft or spacecraft.

While many of the embodiments discussed above may be used with mobile platforms, the invention is not limited thereby. For instance, situational awareness for a teleconference participant includes knowing who is speaking and distinguishing each of the speaking participants from each other even though they may be speaking simultaneously. While humans are able to distinguish several simultaneous conversations when speaking in person with one another, the teleconference environment deprives the participant of the visual cues that would otherwise facilitate distinguishing one source from another. Thus, embodiments of the present invention may also be employed with many different communication systems as will be further discussed.

Figure 4:
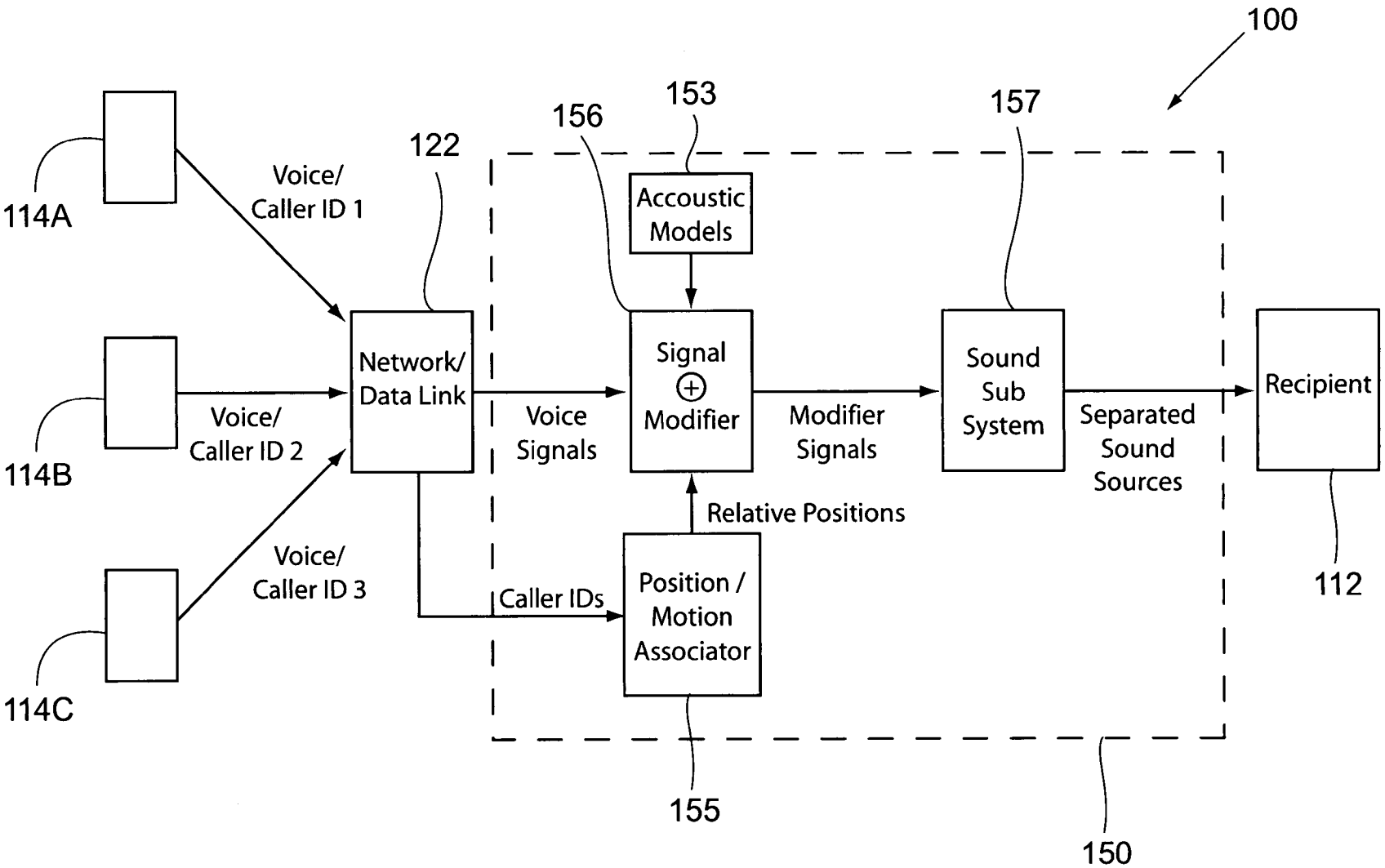
FIG. 4 illustrates another system constructed in accordance with the principles of the present invention.

Now with reference to FIG. 4, another preferred embodiment of the present invention is illustrated. A system 100 includes a plurality of audio signal sources 114, a communication link 122, a position associater 155, an audio signal modifier 156, a sound subsystem 157, and a recipient 112. One of the differences between the system 10 of FIG. 2 and the system 100 of FIG. 4 is that the system 100 generates relative positions for the sources 114 rather than receiving position data from the sources 114. Additionally, the communications link 122 facilitates communications among the multiple sources 114 and the recipient 112 (e.g. the link can provide teleconferencing capabilities to combinations of the sources and the recipient). In a preferred embodiment, the communications link 122 associates an identifier with each source 114 and provides the identifier to the subsystem 150. One such identifier is the caller identification numbers of the sources 114A, 114B, and 114C. Thus, the telephone number associated with each source 114 may be supplied to the subsystem 150 separately from the audio signals from the sources 114. Another useful identifier (when the link 122 includes a teleconferencing system) is the line number on which each of the sources 114 calls into the teleconference. Of course, the link 122 will know, or be programmed to retrieve, the telephone number of the recipient 112.

Using the identifications associated with the sources 114 to distinguish one source from another, the position associater 155 associates a relative position to each of the audio signals from the sources 114. In one embodiment, the relative position is assigned based on a combination of the area codes and prefixes of the sources 114 and the recipient 112. Thus, for teleconferences, the recipient 112 hears the sources 114 as they are distributed about the recipient 112 in the context of the communication system to which the link 122 links and the geographic area that it serves (i.e. nationally or internationally). For local calls, the recipient 112 hears the sources 114 as they are distributed about the recipient 112 in the context of a local telephone exchange (e.g. about the city or locale). In another preferred alternative, the position associater 155 arbitrarily associates a relative position with each of the sources 114. For example, the position associater 155 may appear to place the sources 114 on a circle so that the recipient 114 perceives the sources spaced apart evenly along an imaginary circle around him. The associater 155 forwards the assigned relative positions to the voice modifier 156. Then, using the associated relative positions, the signal modifier 156 modifies the audio signals to convey those relative positions to the recipient 112. Thus, the system 100 may operate to maximize the audible separation of the sources 114 for the recipient 112. In yet another preferred embodiment, each recipient 112 can adjust the relative position associated with each of the sources 114 to best meet his needs, e.g. placing a male and a female voice close together because they can be easily distinguished by vocal quality while placing similar voices far apart to improve awareness of which source is speaking.

In the alternative, the signal modifier 156 may retrieve an acoustic model from a memory 153 for use in modifying the audio signals. Regardless of whether the modifier uses a model 153 to modify the audio signal, or adjusts particular parameters (as previously discussed), the modifier sends the modified audio signal to the sound system 157. The sound system 157 then reproduces the audible signals in accordance with the modification so that the recipient 112 perceives the audible signals as coming from the associated relative positions 132.

Figure 5A:
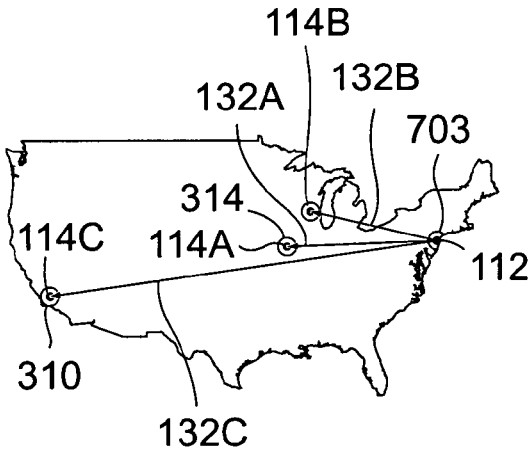
FIG. 5 further illustrates the system of FIG. 4.

FIG. 5A illustrates the separation perceived by the recipient 112 in Washington, D.C. (produced by the system 100 of FIG. 4) of a first source 114A in St. Louis, Mo., from a second source 114B in Chicago, Ill., and from a third source 114C in Los Angeles, Calif. The recipient 112 perceives the audible signal of source 114A as if it is coming from the direction 132A, while the audible signals from sources 114B and 114C are perceived as if coming from the directions of Chicago and Los Angeles, respectively. The directions 132 can be looked up, or calculated, using the area code found in the caller identification signals from the sources 114. Thus, the recipient 112 intuitively associates the sources 114 with their relative positions 132 and is therefore better able to distinguish the sources 114 from each other.

Figure 5B:
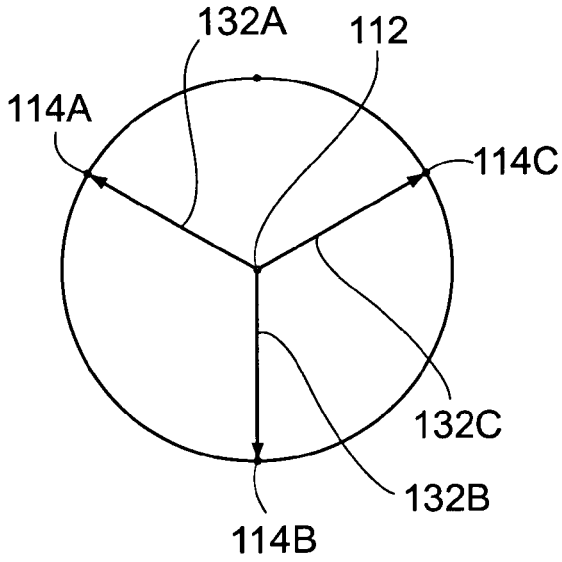

FIG. 5B schematically represents the separation of sources 114 in a system where the actual positions of the sources 114 and the recipient 112 (and mobile platforms under their control) are not of particular importance to the recipient 112. In situations such as these, neither the absolute positions nor the relative positions need be reflected in the perceived positions, although audible separation of the sources 114 is still desired. One such situation is a teleconference in which all of the participating sites can be considered as both sources and recipients. From the perspective of a particular site 112, the other participating sites are sources 114 that the recipient 112 desires to have audibly separated. The system 100 assigns arbitrary relative positions, or directions 132, to each of the sources. To treat each source 114 equally, the system also assigns the positions such that each source 114 will be perceived to be on a circle disposed about the recipient 112. In this manner, the sources 114 will appear to be equidistant. Further, while the directions 132 are shown as being evenly disturbed about the circle, no such restriction is implied for the present invention. In particular, the directions could be grouped on one side, or the other, of the circle. The perceived positions could even be coincident. Such groupings may be useful in simulating a speaker (or source) addressing a group (of recipients) via a teleconference. Also, while the apparent positions of the sources 114 are shown being equidistance from the recipient 112, the perceived relative positions could be at different distances from the recipient 112. Thus, the relative positions 132 may provide any desired degree of separation between the sources 114 when they are associated arbitrarily (i.e. without regard to actual or relative positions) or at the discretion of recipient 112.

In another preferred embodiment an end-of-message marker is added to each signal to provide the recipient yet another cue for identifying the source of the signal. The current embodiment is particularly useful where the signals have a clearly identifiable ending point (e.g. a stream of digital packets in a voice-over-IP stream that's activated by a push-to-talk button). Additionally a specific type of modification can be assigned to the different signals to help identify it or distinguish it. For example, one particular signal carrying a voice stream could be modified in tone (e.g. the speaker could be made to sound like Donald Duck), volume (e.g. the voice of a military officer with higher rank is amplified above the volume of subordinate's voice), or other characteristics. Further, one could add background noise for each of the apparent positions of the signals to aid the recipient. Adding the background noise can thus help the recipient remember and locate others who are online but not speaking. The background noise can also help characterize each speaker. More particularly, clanking tread could be added to the voice stream of a tank driver while the roar of jet engines could be added to a fighter pilot's voice stream as background noise.

Figure 6:
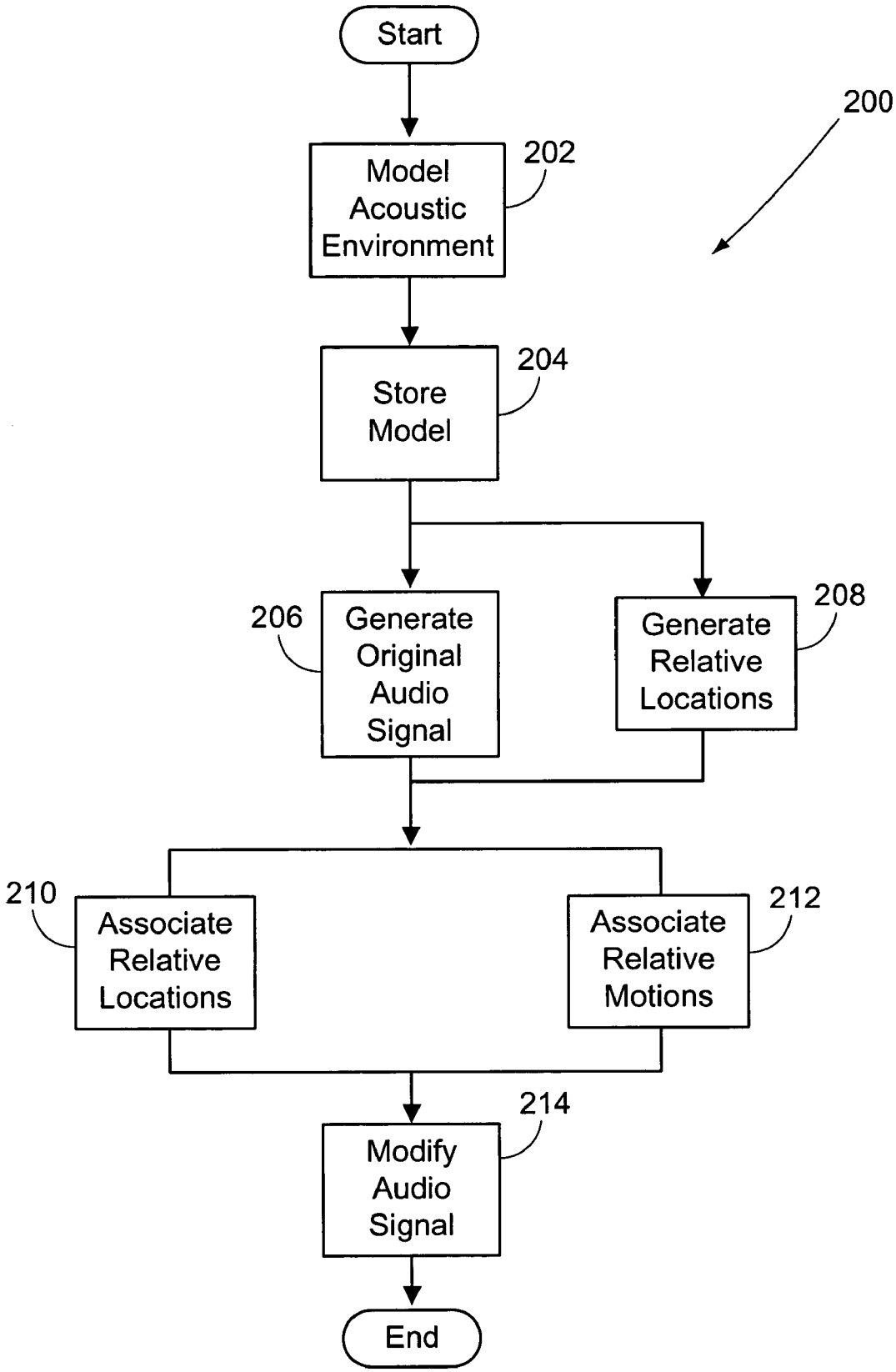
FIG. 6 illustrates a method in accordance with the principles of the present invention.

With reference now to FIG. 6, a method in accordance with a preferred embodiment of the present invention is illustrated. The method 200 includes modeling an acoustic environment to determine how the environment alters audio signals propagating through it. For instance, surfaces in the environment will cause reverb-producing reflections, obstructions will cause echoes, and distance will cause attenuation of the original signal. Thus, as the environment is traversed the audio signal perceived will vary with position. Preferably, the acoustic environment will resemble the locale of interest to the recipient and the source (e.g. an area where the UAVs are to operate). A pre-selected audio signal is then created in the acoustic environment. A sensor, preferably located near the center of the environment, is then used to detect and record the audio signal as altered by the environment. The source of the pre-selected signal is then moved and recorded again with the sensor. The process repeats until the pre-selected signal is generated, and recorded, at a number of points sufficient to adequately characterize the environment. Using knowledge of the pre-selected signal, a model (or transfer function) of the environment may be extracted from the accumulation of recorded signals. The model therefore allows any subsequent audio signal to be modified to reflect how it would be perceived, if the source were located at a particular position in the environment, and as heard from the position of the sensor. Once the model, or transfer function, is determined, it is then stored in operation 204.

At some time, audio signals are generated by at least one source in operation 206. These audio signals are sent to the recipient via any of a wide variety of communications technologies such as electromagnetic links (e.g. RF, Laser, or fiber optic) or even via WANs, LANs, or other data distribution networks. Along with the audio signals, relative position signals may also be generated in operation 208. In the alternative, the relative positions may be derived from absolute position signals. In yet another alternative, the relative positions may be generated in an arbitrary manner as herein discussed. Each audio signal may then have a relative position, and motion, assigned to it in operations 210 or 212, respectively. When relative motions are assigned to an audible signal, the Doppler Effect, crescendos, decrescendos, and other dynamic cues are particularly well suited to convey the relative motion to the recipient. The audio signal may then be modified according to the relative position (and motion) associated with it. The audible signal may then be reproduced for the recipient who perceives the audible signals as if they were originating from their respective relative positions.

In view of the foregoing, it will be seen that the several advantages of the invention are achieved. Systems and methods have been described for providing increased situational awareness via separation of audible sources. The advantages of the present invention include increased capabilities for two, or more operators to cooperate in achieving a common objective. Further, the participants of conversations conducted in accordance with the principles of the present invention enjoy improved abilities to follow the various threads of conversations that occur within the overall exchange. Additionally, the participants waste less time and effort identifying the sources of comments made during the teleconference.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of communicating at least one audio signal from a source that generates the audio signal to a recipient, the method comprising:

associating a relative position with the signal;

modifying the at least one audio signal from the source to convey the relative position; and sending the modified audio signal to the recipient in a manner such that the recipient will perceive an audible signal conveying the relative position associated with the signal.

2. The method according to claim 1, wherein the associating further comprises being arbitrary.

3. The method according to claim 2, wherein the associating occurs in real time.

4. The method according to claim 1, further comprising choosing the relative positions from a set of positions on a circle.

5. The method according to claim 4, the circle being disposed about the recipient.

6. The method according to claim 1, further comprising associating a relative movement with the signal.

7. The method according to claim 6, wherein the modifying further comprises further modifying the signal to convey the relative movement.

8. The method according to claim 1, further comprising associating the source with a mobile platform.

9. The method according to claim 8, wherein the associating further comprises the relative position being a relative position of the mobile platform.

10. The method according to claim 9, wherein the associating further comprises the relative position being with respect to a second mobile platform associated with the recipient.

11. The method according to claim 1, wherein the relative position is a relative spatial position.

12. The method according to claim 1, further comprising the associating being based on a logical address associated with the signal.

13. The method according to claim 1, further comprising speaking to generate the audio signal.

14. The method according to claim 1, the modifying further comprising using a model of an acoustic environment.

15. A system to communicate at least one audio signal from a source that generates the audio signal to a recipient, comprising:

a signal modifier to accept the audio signal;

a position associater to associate a relative position with the audio signal and to communicate the associated relative position to the signal modifier, the signal modifier to modify the audio signal to convey the associated relative position and to output the modified audio signal in such a manner that the recipient to perceive an audible signal conveying the associated relative position.

16. The system according to claim 15, further comprising an audio subsystem in communication with the signal modifier to accept the modified signal and to produce the audible signal from the modified audio signal.

17. The system according to claim 15, further comprising a memory to store an acoustic model and to communicate the acoustic model to the signal modifier, the signal modifier to use the acoustic model to modify the audio signal.

18. The system according to claim 15, further comprising a link to a telephony system to accept the audio signal and a called identification signal, the audio signal to be a voice signal, the position associater to use the caller identification signal in associating the relative position with the audio signal.

19. The system according to claim 15, wherein the association to be arbitrary.

20. The system according to claim 15, wherein the association to be chosen by the recipient.

21. The system according to claim 15, wherein the association to occur in real time.

22. The system according to claim 15, wherein the associated relative position to be on a circle about the recipient, the position associater to associate a second relative position with a second audio signal, the second relative position to be on the circle about the recipient.

23. The system according to claim 15, further comprising a relative movement associater to associate a relative movement with the signal, the signal modifier to modify the audio signal to convey the relative movement.

24. The system according to claim 15, wherein the source to be associated with a mobile platform.

25. The system according to claim 24, wherein the relative position to be a relative position of the mobile platform.

26. The system according to claim 25, wherein the relative position to be with respect to a second mobile platform to be associated with the recipient.

27. The system according to claim 15, wherein the relative positions is a relative spatial position.

28. The system according to claim 15, further comprising the relative position to be based on a logical address associated with the signal.

29. The system according to claim 28, further comprising a database for storing the spatial position of the source and wherein the logical address associated with the signal is used to retrieve the spatial position of the source from a database.

30. The system according to claim 29, wherein the database is a real-time database.

31. The system according to claim 15, wherein the audio signal is a voice signal.

* * * * *